United States Patent [19]

Youngblood et al.

[11] 4,182,422

[45] Jan. 8, 1980

[54] LARGE DIAMETER BIT WITH BRIDGE MOUNTED DRIVE STEM

[75] Inventors: Thomas F. Youngblood, De Soto; William C. Saxman, Irving; Gerald F. Wilemon, Arlington, all of Tex.

[73] Assignee: Dresser Industries, Inc., Dallas, Tex.

[21] Appl. No.: 949,355

[22] Filed: Oct. 6, 1978

[51] Int. Cl.[2] ..... E21C 23/00

[52] U.S. Cl. ..... 175/53; 175/344

[58] Field of Search ..... 175/53, 344, 345, 346, 175/347, 391, 392, 406, 334, 335

[56] References Cited

U.S. PATENT DOCUMENTS

| | | | |
|---|---|---|---|
| Re. 27,597 | 3/1973 | Talbert | 175/334 |
| 2,755,071 | 7/1956 | Kammerer, Jr. | 175/334 X |
| 3,659,659 | 5/1972 | Lichte | 175/53 |
| 3,675,729 | 7/1972 | Neilson | 175/53 |
| 3,750,767 | 8/1973 | Pessier | 175/53 |
| 3,805,901 | 4/1974 | Coski | 175/53 |
| 4,108,259 | 8/1978 | Dixon et al. | 175/53 X |

*Primary Examiner*—James A. Leppink
*Assistant Examiner*—Richard E. Favreau
*Attorney, Agent, or Firm*—Eddie E. Scott

[57] ABSTRACT

A drill bit is shown for enlarging a pilot hole into a larger diameter hole by disintegrating the earth formations that surround the pilot hole. The bit includes a cutterhead with a multiplicity of saddles containing rolling cutters for contacting and disintegrating the formations that surround the pilot hole. The rolling cutters are mounted so that the cutter face profile of the cutters extends in a uniform manner to the edge of the pilot hole and eliminates uncut bottom. A drive stem or stinger projects from the cutterhead. The lower portion of the drive stem or stinger comprises extensions that reach over or "bridge" the inner legs of the center saddles and extend into the available vacant areas between the saddles for attachment to the body of the cutterhead.

3 Claims, 3 Drawing Figures

LARGE DIAMETER BIT WITH BRIDGE MOUNTED DRIVE STEM

FIELD OF THE INVENTION

The present invention relates to the art of earth boring and, more particularly, to a drill bit for boring large diameter holes by enlarging a pilot hole into a larger diameter hole.

BACKGROUND OF THE INVENTION

It is well known in the earth boring art to produce relatively large diameter holes between a first location and a second location in a mine or other underground works by operations commonly referred to as raise drilling and blind hole drilling. A raise drilling operation begins by drilling a small diameter pilot hole through the earth from a first location to an opening at a second location using a small diameter pilot bit. After the pilot hole is completed, the pilot bit is removed from the drill string and a large diameter raise bit is attached to the drill string. The raise bit is rotated and drawn along the pilot hole thereby enlarging the pilot hole to the desired size. A blind hole drilling operation produces a large diameter hole in a single pass. A pilot hole drill bit is mounted on an extension that precedes the blind hole bit.

Many strict requirements are imposed upon drill bits used in boring large diameter holes. The drill bit must be a balanced, high-performance apparatus that is rugged and will perform for a long period of time. Replaceable rolling cutters are located and spaced so that upon rotation of the drill bit every portion of the hole being drilled will be acted upon by one or more of the cutters in order to disintegrate the formations and form the desired large diameter hole. This insures that almost the entire wear in drilling takes place on the cutters rather than on the main bit body. The cutters are readily replaceable thereby allowing the life of the drill bit to be extended by replacing the individual cutters. Inefficiency and rapid wear is often associated with the cutters in the immediate area of the drive stem. This is due to cutter mounting limitations and the difficulty in positioning the cutting surfaces of the innermost cutters adjacent the drive stem.

DESCRIPTION OF PRIOR ART

In U.S. Pat. No. 3,659,659 to Carl L. Lichte, patented May 2, 1972, a bit for boring a large diameter hole is shown. The body of the bit includes a multiplicity of stages around a central axis. The bit is attached to the drill column by a replaceable stem connected to the main body of the bit and the body of the bit includes a series of plates separated by a series of hollow support elements.

In U.S. Pat. No. 3,633,691 to Milton L. Talbert, patented Jan. 11, 1972, a bit for drilling large diameter holes is shown. Cutters are arranged in a stage configuration around the central shaft. The innermost cutters are the same large cutters used at other locations on the bit allowing complete interchangeability. The innermost cutters are turned inward. This reduces the uncut bottom next to the pilot hole and provides a stronger bit because the central shaft has not been weakened by milling or other operations.

In U.S. Pat. No. 3,638,740 to Dan B. Justman, patented Feb. 1, 1972, a rotary drill for producing a raise bore including a body having roller cutter assemblies arranged to cut the working face of an earth formation so that the plane of an inner portion of the working face inclines downwardly and inwardly towards a pilot hole, and the plane of an outer portion of the working face inclines downwardly and outwardly towards the gage of the raise bore, and the plane of an intermediate portion of the working face extends between the inner and outer inclined portions is shown.

In U.S. Pat. No. 3,750,767 to Rudolf Carl Otto Pessier, patented Aug. 7, 1973, a reaming type rock boring drill having an innermost cutter, rotatably supported as a beam is shown. A sleeve or other support member disposed close to, but spaced apart from, the drill stem that forms a portion of the bit body serves as a trunnion or journal for the inner end of the load pin of the cutter bearing assembly. Drilling with such an assembly results in an uncontacted kerf or rock contigous with the pilot hole. This kerf is disintegrated by mounting the innermost cutter so that the forces applied to the borehole bottom by this cutter act along a line directed into the formation and inwardly toward the pilot hole. As a result, a much higher cutting efficiency is achieved, when contrasted with earlier dispositions in which the innermost cutter acted directly on the bottom of the borehole immediately adjacent the pilot hole.

In U.S. Pat. No. 4,007,799 to Robert L. Dixon and Robert E. Allison, patented Feb. 15, 1977, a raise type of earth boring drill in which the cutter assembly is detachably secured to the drive stem to permit replacement of the stem is shown. The stem slidably engages a central opening in the cutter assembly, the cutter assembly engaging a shoulder on the stem which carries axial loads in the drill. The cutter assembly is detachably anchored by a plurality of bolts to a torque plate attached to the end of the stem for transmitting torque load to the cutter assembly, the bolts clamping the cutter assembly against the shoulder.

SUMMARY OF THE INVENTION

The present invention provides a large diameter drill bit for enlarging a pilot hole into a larger diameter hole by disintegrating the earth formations that surround the pilot hole. The bit includes a cutterhead with a multiplicity of saddles containing rolling cutters for contacting and disintegrating the formations that surround the pilot hole. The rolling cutters are mounted so that the cutter face profile extends in a uniform manner to the edge of the pilot hole and eliminates uncut bottom. A drive stem or stinger projects from the cutterhead. The lower portion of the drive stem or stinger comprises extensions that reach over or "bridge" the inner legs of the center saddles and extend into the available vacant areas between the saddles for attachment to the body of the cutter head. The above and other features and advantages of the present invention will become apparent from a consideration of the following detailed description of the invention when taken in conjunction with the accompanying drawings.

DETAILED DESCRIPTION OF THE INVENTION

Figure 1:
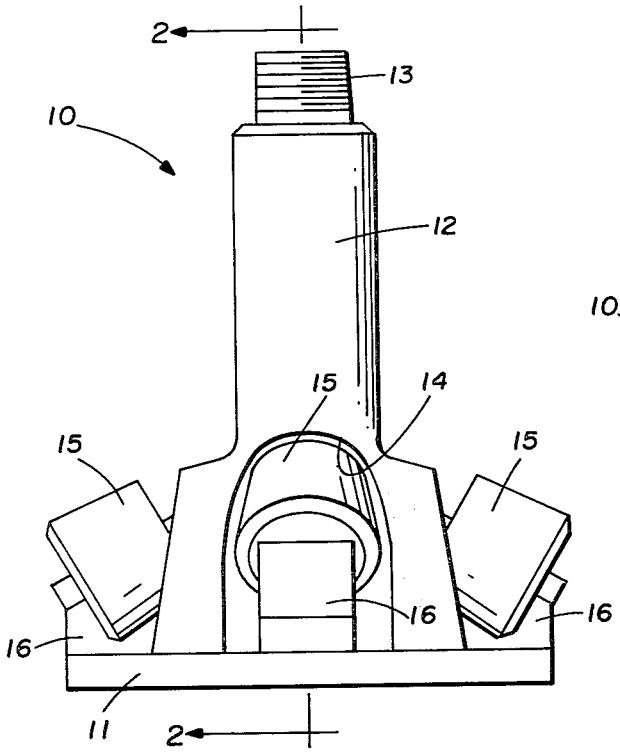
FIG. 1 is a side view of a drill bit constructed in accordance with the present invention.

Referring now to the drawings and, in particular, to FIG. 1, an earth boring bit of the present invention and the method of manufacturing an earth boring bit in accordance with the present invention will be illustrated. The earth boring bit is generally designated by the reference number 10. A main plate 11 forms the basic framework of the bit 10. A central drive stem 12 projects from the main plate 11. It is to be understood that a stinger could be used instead of the drive stem 12. The upper portion 13 of the drive stem 12 is threaded to allow the bit 10 to be easily connected to, and disconnected from, a rotary drill string (not shown).

The present invention provides an earth boring bit that incorporates a more effective cutter arrangement for improved drilling performance and cutter life. The inefficiency and rapid wear often associated with the cutters in the immediate area of the drive stem due to mounting limitations, is eliminated by employing a drive stem or stinger that allows these cutters to be placed in their most advantageous operating position. In addition, a reduction of fabrication costs results since less critical machining of both the drive stem (or stinger) and cutterhead body is required and only one type of cutter and saddle mount is needed for all cutter positions.

The center cutters of conventional cutterheads are located as close to the stem as possible to reduce the amount of uncut earth formation between the nose of the cutter and the stem. However, orienting these cutters in a position to provide the ideal common cutting plane with the outer cutters, while still maintaining this small uncut bottom adjacent the stem, usually requires integral mounting provisions involving costly machining operations and considerable stock removal to the stem which can weaken it. Alternate methods include the use of special cutters and/or saddles designed specifically for this inner row or positioning the inner cutters in a position that interrupts the ideal common cutting plane.

As shown in FIG. 1, a multiplicity of saddles 16 are mounted on the main plate 11 containing a corresponding multiplicity of rolling cutters 15. The rolling cutters 15 contact and disintegrate the formations surrounding the pilot hole during the raise drilling operation. The cutterhead of this invention employs drive stem 12 that presents no interference to the center cutters since it attaches to the cutterhead body at points between the cutters after they have been placed in their most effective operating positions. The cutters can be placed as close together radially as their saddles will allow, since the stem has no lower shank that must extend between them, hence, no costly central bore and hub arrangement in the body is required. The cutterhead comprises a series of rolling cutters mounted such that the cutter face profile extends in a uniform manner to the edge of the pilot hole, eliminating uncut bottom. The lower portion of the stem includes extensions that reach over or "bridge" the inner legs of the center saddles and extend into the available vacant areas between the saddles for attachment, for example by being welded or bolted, to the main plate 11. An archway 14 is provided for the inner cutters. The saddles supporting the inner cutters fit into the archway and bring the cutting surfaces of the cutters to the pilot hole thereby eliminating uncut bottom.

Figure 2:
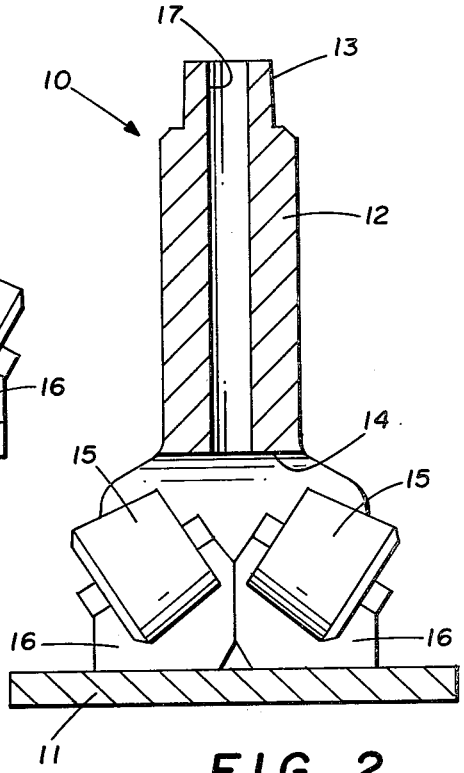
FIG. 2 is a side view, partially in section, taken along lines 2—2 of the raise head shown in FIG. 1.

Referring now to FIG. 2, a view in partial section, taken along lines 2—2 of FIG. 1 is shown. The archway 14 allows the saddles 16 of the inner cutters 15 to be positioned immediately adjacent each other. The legs of the drive stem 12 extend between the cutters mounted in their saddles. The legs are affixed to the main plate 11. The drive stem 12 is attached to the cutterhead body without interfering in any way with the most effective operating position of the rolling cutters adjacent the stem. This cutter placement results in continuation of the same straight cutting profile that is produced by the other cutters. This eliminates profile changes which would result in premature wear. This reduces uncut bottom at the stem while maintaining the same profile.

The structural details of an embodiment of an earth boring bit 10 constructed in accordance with the present invention having been described, the drilling operation will now be considered with reference to FIGS. 1 and 2. The bit 10 shown in FIGS. 1 and 2 is a raise drilling bit, however, it is to be understood that the invention can be incorporated in a blind hole bit wherein a stinger produces a pilot hole preceeding the main cutterhead. A raise drilling operation begins by drilling a small diameter pilot hole through the earth from a first location to an opening at a second location using a small diameter pilot bit. After the pilot hole is completed, the pilot bit is removed from the drill string and a raise head such as the raise head 10 is attached to the drill string. The raise head is rotated and drawn along the pilot hole thereby enlarging the pilot hole to be desired size. The conical cutter profile results in the raise head 10 acting efficiently on the formations being bored. The drive stem 12 is attached to the cutterhead body without interfering in any way with the most effective operating position of the rolling cutters adjacent the stem. This cutter placement results in a continuation of the same straight cutting profile that is produced by the other cutters. This eliminates profile changes which could result in premature wear. This reduces uncut bottom at the stem while maintaining the desired profile.

Figure 3:
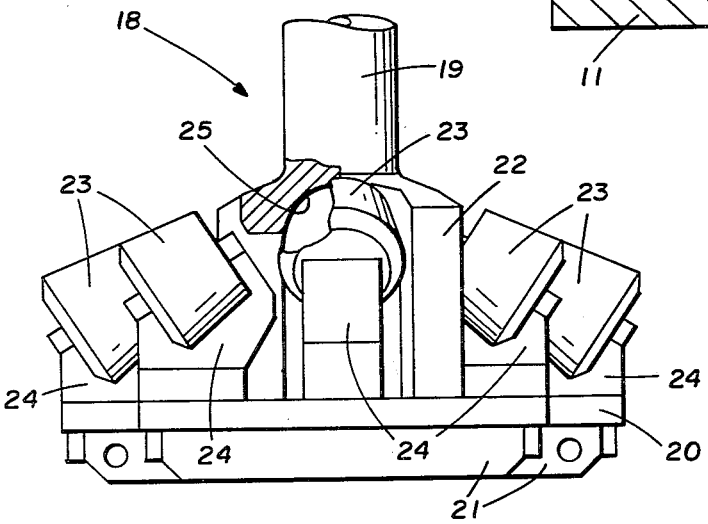
FIG. 3 is a view of another embodiment of a bit constructed in accordance with the present invention.

Referring now to FIG. 3, another embodiment of an earth boring bit constructed in accordance with the present invention is illustrated. The earth boring bit is a raise bit generally designated by the reference number 18. A main plate 20 and gussets 21 form the basic framework of the bit 18. A central drive stem 19 projects from the main plate 18. The upper portion of the drive stem 19 is threaded to allow the bit 18 to be easily connected to, and disconnected from, a rotary drill string (not shown). A multiplicity of saddles 24 are mounted on the main plate 20 containing a corresponding multiplicity of rolling cutters 23. The rolling cutters 23 contact and disintegrate the formations surrounding the pilot hole during the raise drilling operation. A throat or archway 25 allows the saddle 24 of the inner cutters 23 to be positioned immediately adjacent each other. The legs 22 of the drive stem 19 extend between the cutters mounted in their saddles. The legs 22 are affixed to the main plate 20. The drive stem 19 is attached to the cutterhead body without interfering in any way with the most effective operating position of the rolling cutters adjacent the stem. This cutter placement results in continuation of the same straight cutting profile that is produced by the other cutters. This eliminates profile changes which would result in premature wear. This reduces uncut bottom at the stem while maintaining the same profile.

The embodiments of the invention in which an exclusive property or privilege is claimed are defined as follows:

1. A large diameter bit for boring a large diameter hole by disintegrating the earth formations surrounding a pilot hole, comprising.

a main body portion including a main plate;

a pair of inner cutter saddles mounted on said main body portion, said inner cutter saddles located opposite each other on said main body portion and positioned adjacent each other;

a multiplicity of additional cutter saddles mounted on said main body portion, said pair of inner cutter saddles and said additional cutter saddles positioned on said main body portion to leave spaces between said inner cutter saddles and said additional cutter saddles;

a pair of inner rolling cutters mounted in said inner cutter saddles for contacting and disintegrating earth formations surrounding the pilot hole;

a multiplicity of additional rolling cutters rotatably mounted in said additional cutter saddles, said inner rolling cutters and said additional rolling cutters providing a straight cutter profile that extends in a uniform manner to said pilot hole;

a stem member; and means connecting said stem member to said main body portion, said means including an arch on said stem member to bridge over said pair of inner cutters saddles and said pair of inner rolling cutters mounted in said inner cutter saddles and legs extending around said arch that extend into said spaces between said inner cutter saddles and said additional cutter saddles.

2. A raise bit for enlarging a pilot hole into a larger diameter hole by disintegrating earth formations surrounding the pilot hole, comprising:

a drive stem having an upper end for projecting into said pilot hole and a lower end;

a threaded connection on the upper end of said drive stem;

a main plate;

a pair of inner saddles mounted on said main plate, said inner saddles located opposite each other on said main plate and positioned adjacent each other;

a pair of inner rolling cutters mounted in said inner saddles;

a multiplicity of additional saddles mounted on said main plate, said pair of inner saddles and said additional saddles positioned on said main plate to leave spaces between said inner saddles and said additional saddles;

a multiplicity of additional rolling cutters positioned in said additional saddles, said inner rolling cutters and said additional rolling cutters providing a straight cutter profile that extends in a uniform manner to said pilot hole;

an arch passageway on said lower end of said drive stem having legs extending from the lower end of said drive stem into said spaces between said inner saddles and said additional saddles; and means connecting said legs extending from the lower end of said drive stem to said main plate with said pair of inner saddles and said inner rolling cutters mounted in said inner saddles positioned in said arch passageway.

3. An earth boring bit for boring a large diameter hole by disintegrating the earth formations surrounding a pilot hole, comprising:

a main body portion including a main plate;

a pair of inner saddles mounted on said main body portion, said inner saddles positioned adjacent each other;

a pair of inner rolling cutters mounted in said pair of inner saddles;

a multiplicity of additional saddles mounted on said main body portion, said inner saddles and additional saddles positioned on said main body portion to leave spaces between said inner saddles and said additional saddles;

a multiplicity of additional rolling cutters mounted in said additional saddles, said inner rolling cutters and said additional rolling cutters providing a straight cutter profile that extends in a uniform manner to said pilot hole; and a stem member for projecting into said pilot hole, said stem member having an archway passage and legs extending from said archway passage with said legs extending into said spaces between said inner saddles and said additional saddles attached to said main body portion and said pair of inner saddles and said pair of inner rolling cutters located substantially within said archway passage.

* * * * *

UNITED STATES PATENT OFFICE

CERTIFICATE OF CORRECTION

Patent No. 4,182,422 Dated January 8, 1980

Inventor(s) Thomas F. Youngblood, William C. Saxman, Gerald F. Wilemon

It is certified that error appears in the above-identified patent and that said Letters Patent are hereby corrected as shown below:

Column 6, line 43, after "saddles" insert --and--.

Signed and Sealed this

*Twenty-fifth* Day of *March 1980*

[SEAL]

*Attest:*

SIDNEY A. DIAMOND

*Attesting Officer*

*Commissioner of Patents and Trademarks*